US007484343B2

(12) United States Patent
Dickner

(10) Patent No.: US 7,484,343 B2
(45) Date of Patent: Feb. 3, 2009

(54) APPLICATION OF LOADING LEDGES

(75) Inventor: Allan Dickner, Älmhult (SE)

(73) Assignee: Inter Ikea Systems B.U., Delft (NL)

( * ) Notice: Subject to any disclaimer, the term of this patent is extended or adjusted under 35 U.S.C. 154(b) by 441 days.

(21) Appl. No.: 10/990,371

(22) Filed: Nov. 18, 2004

(65) Prior Publication Data

US 2005/0108989 A1 May 26, 2005

(51) Int. Cl.
*B65B 61/00* (2006.01)

(52) U.S. Cl. ..... 53/139.7; 53/139.5

(58) Field of Classification Search ..... 53/139.5, 53/139.6, 139.7, 399, 580, 582, 589; 206/386, 206/599, 600; 108/51.11, 53.1
See application file for complete search history.

(56) References Cited

U.S. PATENT DOCUMENTS

| | | | | |
|---|---|---|---|---|
| 2,895,608 | A * | 7/1959 | Wilson | 206/599 |
| 3,097,741 | A * | 7/1963 | Schwartz | 206/599 |
| 3,331,496 | A * | 7/1967 | Marsden et al. | 206/600 |
| 3,585,780 | A * | 6/1971 | Elmore | 53/139.7 |
| 3,783,773 | A * | 1/1974 | Willard et al. | 53/589 |
| 3,880,286 | A * | 4/1975 | Wegener | 206/600 |
| 3,883,013 | A * | 5/1975 | Nakanishi et al. | 414/281 |
| 4,148,394 | A * | 4/1979 | Bederman | 206/599 |
| 4,317,517 | A * | 3/1982 | Tisdale | 206/599 |
| 4,587,791 | A | 5/1986 | Brouse et al. | |
| 4,717,025 | A * | 1/1988 | Maurer | 206/599 |
| 4,960,209 | A * | 10/1990 | Tudor | 206/600 |
| 5,154,297 | A * | 10/1992 | Farley | 206/599 |
| 5,400,706 | A * | 3/1995 | Tipton et al. | 53/589 |
| 5,596,863 | A | 1/1997 | Kasel | |
| 6,168,222 | B1 * | 1/2001 | Lacy, III | 53/399 |
| 6,550,741 | B1 * | 4/2003 | Cottone | 108/51.11 |
| 6,941,877 | B2 * | 9/2005 | Dickner | 108/51.11 |
| 2005/0144910 | A1 * | 7/2005 | Snodgrass | 53/399 |

* cited by examiner

*Primary Examiner*—Louis K Huynh

(57) ABSTRACT

A system for applying loading ledges onto a unit load positioned on supporting means. The system comprises an application machine. The system also comprises means for separating the unit load from the supporting means in the vertical direction. The system also comprises means for applying one or more loading ledges to two or more opposite, lower edges of the unit load when separated from the supporting means.

10 Claims, 10 Drawing Sheets

APPLICATION OF LOADING LEDGES

This application is a 371 national stage of PCT/SE03/00635 filed Apr. 22, 2003.

TECHNICAL FIELD

The present invention relates to a system for applying loading ledges onto a unit load positioned on supporting means. The system comprises an application machine. Moreover, the present invention relates to a method for applying the loading ledges by using the system.

DESCRIPTION OF PRIOR ART

Systems according to the prior art for applying packages on for example pallets often use a stock of pallets, e.g. wooden pallets, in communication with means for transporting each pallet on a path into a package loading area. In the package loading area, each package, if it is a large package, or several packages, if they are small, is/are loaded onto its pallet forming a unit load. The unit load is then transported, e.g. to a strapping or wrapping area, where the package/s is/are secured to the pallet for further transport or handling.

One disadvantage for these application systems or machines is that they have a short working cycle. This means that these systems only can produce a small number of unit loads consisting of one or more packages because the stock of pallets in the system is small. Consequently, the pallet pile often has to be refilled with new pallets requiring more manual work. Alternatively, the size of the required space for the application systems increases if the pallet stock is enlarged, especially when wooden pallets are being used.

Another disadvantage, when wooden pallets are used, is that the feeding of the pallets from the storage onto the transport path is easily interrupted if pallets are stuck, jammed or hook together because of damaged pallets. The pallets can have damages in the form of nails or wood pieces sticking out, broken wood with pieces missing or wood pieces that are not holding together properly. Moreover, two or more wooden pallets may stick together due to too rough wooden surfaces creating a too high friction.

A problem is that the wooden pallets have fixed standard sizes. This means that packages having a size not corresponding to the size of the wooden pallets make it difficult to optimise the filling grade of the truck or train. Furthermore, empty wooden pallets are heavy and occupy a large volume, whereby a lot of "air" and weight are transported together with empty wooden pallets, whereby the number of transports increase.

Another problem when packages are to be applied on wooden pallets is that packages, which have a width not corresponding to the width of the wooden pallets, have to be positioned symmetrically on the wooden pallets. This is done because of weight distribution and for making wrapping and/or strapping of the unit loads easier in subsequent steps. This means that the packages have to be adapted to the wooden pallets and not vice versa.

Moreover, wooden pallets are difficult to recycle due to the mixture of different materials, i.e. wood and metal nails that have to be separated during recycling.

The problem of having packages with widths differing from the width of the wooden pallets is solved by using separate loading ledges instead. These loading ledges have an essentially angular cross-section similar to a L-shape. The loading ledges are applied onto the opposite lower edges of each unit load. These loading ledges have to be applied by other means than those used for applying unit loads on wooden pallets. This give rise to new problems involving the design of other means for storing, feeding, applying, and transporting both loading ledges and associated unit loads.

The loading ledges also have to be recycled by using means other than those used for wooden pallets.

SUMMARY OF THE INVENTION

One object of the present invention is to simplify the application of loading ledges on unit loads by means of an application machine and method utilising the application machine according to the invention.

A system according to the invention is used for applying loading ledges onto a unit load positioned on supporting means. The system comprises a application machine. The system also has means for separating the unit load from the supporting means in the vertical direction and means for applying at least one loading ledge to at least two opposite, lower edges of the unit load when separated from the supporting means.

The system according to the invention also uses a method for application of the loading ledges. The method comprises a first step of placing a unit load in a first application position in the application machine. Then, in the next step, the unit load is separated from the supporting means in the vertical direction so that the unit load is positioned in a second application position in the application machine. This is followed by applying at least one loading ledge to at least two opposite, lower edges of the unit load. After that, the unit load is moved in the vertical direction into contact with the at least one loading ledge at opposite edges, and, finally, the unit load with loading ledges is removed from the application machine.

By using a system, an application machine and method according to the invention, the following advantages are obtained. The required storage area is minimised, the transport and application of pallets, in this case, loading ledges is enhanced by being more flexible and simplified. Old application systems are easily updated due to the module thinking when inventing this new system according to the present invention. Furthermore, the maintenance of the inventive application system and application machine is simplified. Moreover, the feeding and application of loading ledges on the units loads are more reliable in comparison to wooden pallets. The recycling of loading ledges is also enhanced and simplified, compared to recycling of pallets. All of these advantages reduce the costs for manufacture, storing, feeding, application, transport, and recycling of the loading ledges.

BRIEF DESCRIPTION OF THE DRAWINGS

The invention will now be described in more detail with reference to the accompanying drawings, in which.

DETAILED DESCRIPTION OF THE INVENTION

Figure 1:
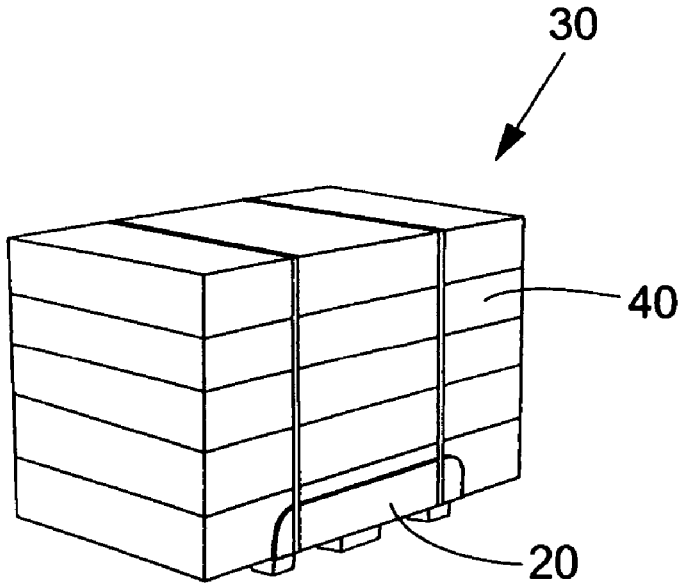
FIG. 1 is a perspective view showing a unit load with loading ledges.

FIG. 1 shows a unit load 30 comprising at least one package 40. One of two loading ledges 20 is positioned at one bottom edge of the unit load and attached to the unit load by straps. The other loading ledge (not shown) is positioned and in contact with the opposite bottom edge of the unit load.

Figure 2:
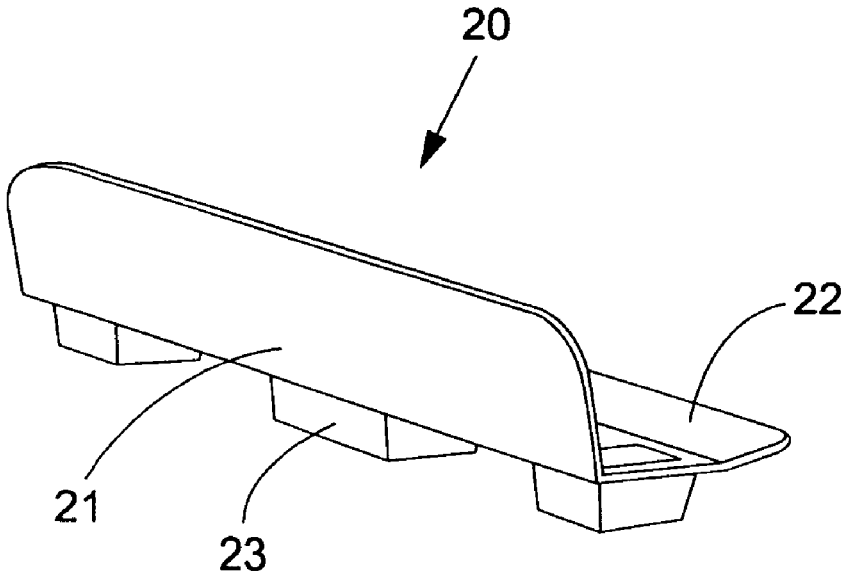
FIG. 2 is a perspective view showing a loading ledge.

FIG. 2 shows the loading ledge 20 in more detail. The loading ledge comprises one vertical flange 21, one horizontal flange 22, and at least one support 23 in the form of a foot. The support is hollow so that another loading ledge (not shown) may be stacked on the shown loading ledge.

Figure 3:
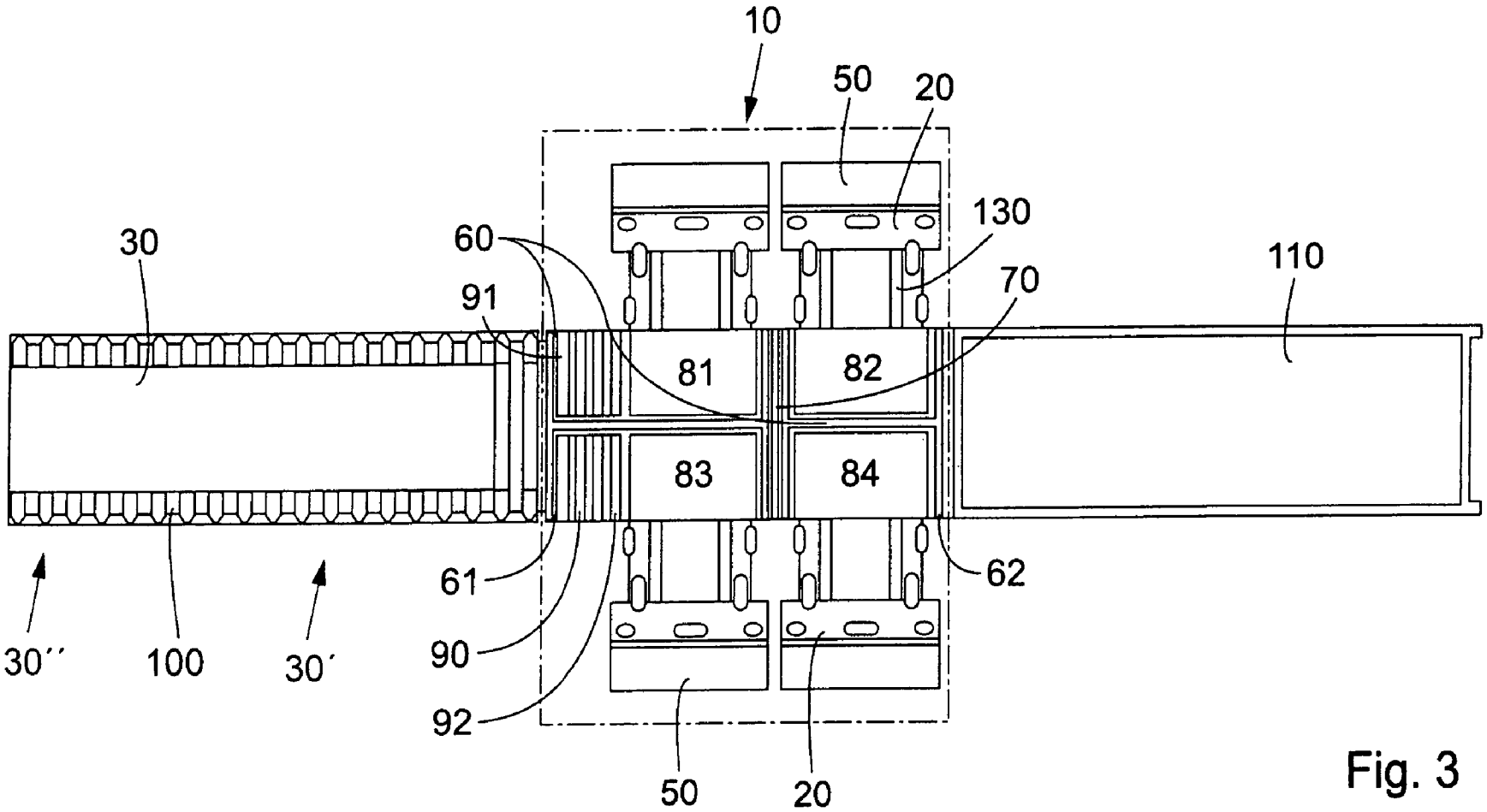
FIG. 3 is a plan view showing an application system according to the invention.

FIG. 3 shows a machine 10 for application of loading ledges 20 onto the unit load 30 comprising the at least one package 40. Each package, preferably of corrugated board, cardboard, paper, or any suitable package material may contain any kind of product/s for further transport or storage.

Each package 40 can be large, e.g. large enough to create the unit load 30 consisting of only one package, or small. A few or several small packages would form the final unit load in the latter case, as shown in FIG. 1.

FIG. 3 shows the application machine 10 with ledge feeders 50 for storing and feeding loading ledges 20, which will be applied onto two opposite, lower edges of the unit load 30. The application machine comprises a vertically movable lifting frame 60 designed essentially as two separate H-profiles 61 and 62, as seen from above in FIG. 3. The means for moving the lifting frame up and down in the vertical direction will be explained later in this description. The H-profile 61 to the left in FIG. 3 is larger or longer, seen in the transport direction of the unit loads 30, than the H-profile 62 to the right in FIG. 3. The H-profile 61 to the left in FIG. 3 could of course have the same length or a length smaller than the H-profile 62 to the right in FIG. 3, if required, which is readily understood by a skilled person. The H-profiles have the same height seen in the direction perpendicular to the unit load transport direction. Each unit load 30 is moved from the left to the right in FIG. 3. The lifting frame 60 has support rollers 70 for enhancing the transport of each unit load 30.

In FIG. 3, each unit load 30 reaches a bottom conveyor 80 when moved into the application machine 10. The bottom conveyor 80 receives a first end 30' of the unit load. The unit load is moved until its' ends, i.e. the first end and a second end 30" protrude or have a overhang outside the bottom conveyor being essentially equal at each end. This is done so that each unit load is symmetrically positioned in the application machine. This symmetrical position is a first application position. After the application of loading ledges 20, the bottom conveyor 80 then moves the unit load 30 to a second output/feeding position. This will be explained in more detail when the method for applying the loading ledges is explained later. Support rollers 90 are used for receiving each unit load coming from a loading conveyor 100 placed to the left in FIG. 3. A feeding conveyor 110 to the right in FIG. 3 receives each unit load 30 after the application of loading ledges 20 is ended.

In FIG. 3 four ledge feeders 50 are placed in pairs, each pair being formed by two ledge feeders. The ledge feeders are placed opposite each other in each ledge feeder pair, whereby each ledge feeder pair forms a module like part in the application machine 10. Each ledge feeder 50 also forms a storage or stack for a large number of loading ledges 20, which are stacked upon each other.

The ledge feeders 50 are positioned so that each pair of ledge feeders forms a module, as explained above, whereby each pair of ledge feeders is easily replaced or simply removed, if required. Additional ledge feeders may also easily be mounted into the application machine 10 so that more than two pairs of ledge feeders are used.

The bottom conveyor 80 comprises four synchronised bottom conveyors 81, 82, 83, 84, which are placed inside the lifting frame 60, which lifting frame forms an enclosure around at least two sides of each bottom conveyor. The bottom conveyors 81 and 83 to the left in FIG. 3 are enclosed by the larger left H-profile 61 of the lifting frame 60. The bottom conveyors 82 and 84 to the right in FIG. 3 are enclosed by the smaller right H-profile 62 of the lifting frame 60.

The bottom conveyors 81, 82, 83, 84 in this embodiment are band conveyors having bands in the form of wooden lamellas. The bottom conveyors could of course have lamellas in any other suitable material giving a sufficient friction between each unit load 30 and transport surface of the conveyors. Each of the conveyors 81, 82, 83, 84, 100, and 110 of the application system 10 comprises control means, at least one drive roll or pulley, at least one support roll or pulley, and means for removably attaching the conveyors 81, 82, 83, 84, 100, and 110 to associated parts of the application machine. Each of the conveyors also comprises other necessary means for operating each conveyor. This is readily understood by a skilled person. These means are common on the market and will therefore not be explained further. The bands of the conveyors could of course have any other shape instead of lamellas as long as the function of transporting each unit load 30 is achieved by a sufficient friction.

The type of conveyors to be used in the application machine 10 according to the invention is chosen in relation to the shape and size of the unit load 30. The features of the outer surface of the unit load also are of importance. This means that the friction between the bottom surface of each unit load and the top or transporting surface of the bottom conveyor 80 has to be sufficiently high when in contact so that each unit load does not slide during transport.

In other embodiments, the bottom conveyors 81, 82, 83, 84 may be replaced by other means for moving or transporting the unit load 30 in and out of the application machine 10. These other means could for example be devices that uses an unsymmetrical, e.g. an eccentric shape, for pushing the unit load incrementally in and out of the application machine. Automatically or manually operated lifts may also move each unit load in and out of the application machine, these lifts could be fork lifts or even manually operated lifting devices, e.g. blocks and falls. If each unit load would be lifted in and out of the application machine, the moving bottom conveyors 81, 82, 83, 84, 100 and 110 could be replaced by fixed devices. Moreover, all the support rollers 90 and 70 could also be eliminated. These fixed devices could be in the form of fixed plates or surfaces having the same size or area as the conveyors and/or support rollers when seen from above, as shown in FIG. 3. Alternatively, the lifting frame 60 could be fixed and the plates or surfaces could be movable in the vertical direction.

The unit load support rollers 90 comprise two rows of rollers, one left row 91 and one right row 92, as seen in the longitudinal direction of the conveyors 81, 82, 83, 84, 100 and 110. Each of the rollers in the left roll row 91 has a length essentially corresponding to the width of the bottom conveyors 81 and 82. The rolls of the left roll row 91 are placed in parallel with the drive and support rolls (not shown) for these two conveyors. Each of the rollers in the right roll row 92 has a length essentially corresponding to the width of the bottom conveyors 83 and 84. The rolls of the right roll row 92 are also placed in parallel with the drive and support rolls (not shown) for these two conveyors. Each of the rows 91, 92 of load unit support rollers is enclosed at two sides by the left H-profile 61 of the lifting frame. The left row 91 of the load unit support rollers 90 is enclosed at the side adjacent the loading conveyor 100 and right ends by the larger, left H-profile 61 of the lifting frame 60. The right row 92 is enclosed at the side adjacent the loading conveyor 100 and left ends by the larger, left H-profile 61 of the lifting frame. The two rows 91, 92 of support rollers are enclosed at a third side by the respective bottom conveyor 81 or 83 in FIG. 3. The two rows 91, 92 of unit load support rollers are enclosed at their fourth side by a conveyor frame (not shown).

In this embodiment, shown in FIG. 3, the vertically movable lifting frame 60 is made of flat bars, which, preferably, are made of metal but could of course be made of any other suitable material that is sufficiently durable. The lifting frame bars are designed and placed edgeways so that they are sufficiently stiff when lifting a unit load 30 and only use a small area in comparison to the area of the conveyors 81, 82, 83 and 84. The lifting frame may also be manufactured by other types of bars instead of flat bars, e.g. round bars, hollow or solid square steel bars. The lifting frame could even be made of beams, e.g. in the form of I- or H-beams, fulfilling the demands of durability in relation to occupied area. The area of the lifting frame 60 being in contact with the bottom area of each unit load 30 when supported is adapted for distributing the weight of the unit load so that damages on the unit load are eliminated.

The lifting frame 60 is lifted in the vertical direction by a lifting mechanism (not shown). The lifting mechanism is designed as turnable arms in this embodiment. Each arm is rotatably fixed at a first end against the conveyor frame of the bottom conveyors 81, 82, 83, 84, and equipped with a roll at a second free end. There are a total number of eight arms; four of them to lift the left lifting frame 61 and the other four to lift the right lifting frame 62. The arms are placed below each lifting frame with their rolls in contact with the associated lower edge of each lifting frame 61, 62 from below. The rolls are the contacting parts between the arms and the lower edges of the lifting frames 61 and 62 when lifting and lowering the lifting frame. This means that the rolls roll against the lower edges of the lifting frames when the arms are rotated. Each of the arms is essentially horizontal before lifting and after lowering of the lifting frames, and essentially vertical after lifting the lifting frames and during the application of loading ledges 20. Each arm performs a synchronised rotational movement and may be rotated by, for example, an electric motor or any other suitable means. The arms do not perform a whole rotation, they are only turned from an essentially horizontal position, i.e. from an angle about 0° from the horizontal, to an essentially vertical position, i.e. to an angle about 90° from the horizontal. The lifting frames 61 and 62 may of course be moved up and down in the vertical direction by any other suitable means, e.g. pneumatically or hydraulically driven cylinders, which are attached to the lifting frame with their piston rod and fixed to the conveyor frame at the other end.

Figure 4:
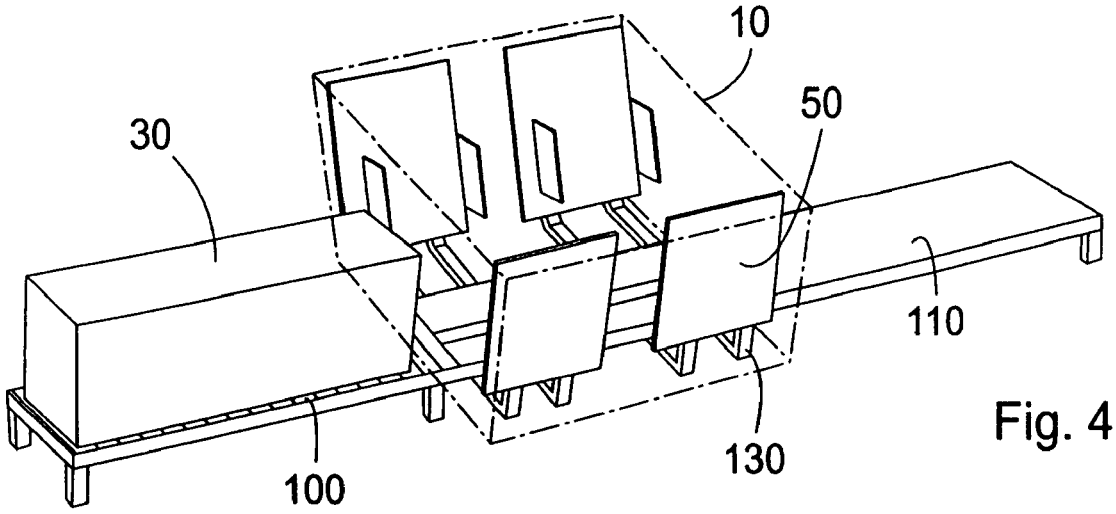
FIG. 4 is a perspective side view showing the application system in FIG. 1.

FIG. 4 shows the main parts of the application machine 10 according to the invention in a perspective view. Here, the unit load 30 with packages 40 is seen to the left on the loading conveyor 100. The unit load in FIG. 4 is shown transparent for clarity reasons. The four ledge feeders 50 are seen in the middle in FIG. 4. Each ledge feeder has a stack/pile of loading ledges 20, each of the ledge feeders is somewhat angled, i.e. each ledge feeder 50 is attached with an angle of 5° to 45° from the vertical direction, preferably 5° to 25°. Each ledge feeder 50 could of course be positioned straight up in the vertical direction, as is readily understood by a skilled person. If the ledge feeders would be positioned straight up in the vertical direction, the ledges would have to be prevented from falling out of the ledge feeders by some kind of stop, e.g. a wall or a guiding beam.

In this embodiment, each ledge feeder 50 of the application machine 10 is mounted onto a bottom frame 120 (shown in FIGS. 5 and 7) by means of a support 130 (shown in FIGS. 3, 4, 5, and 9). The bottom frame 120 also connects the loading conveyor 100 with the feeding conveyor 110. The bottom frame 120 forms the support for the bottom conveyors 81, 82, 83 and 84, the lifting frame 60, the unit load support rollers 90 (shown in FIG. 3), the ledge feeder supports 130, and the ledge feeders 50.

Each ledge feeder 50 and/or even conveyor 81, 82, 83, 84 of the application machine 10 can also, as an alternative, be mounted beside the application machine as a separate unit with other types of connecting means for transporting and mounting the loading ledges 20 onto each unit load 30. The connecting means would then be placed between the application machine and each ledge feeder. Moreover, the loading and feeding conveyors 100 and 110, which form the application system together with the application machine 10, may also be separate units.

Figure 5:
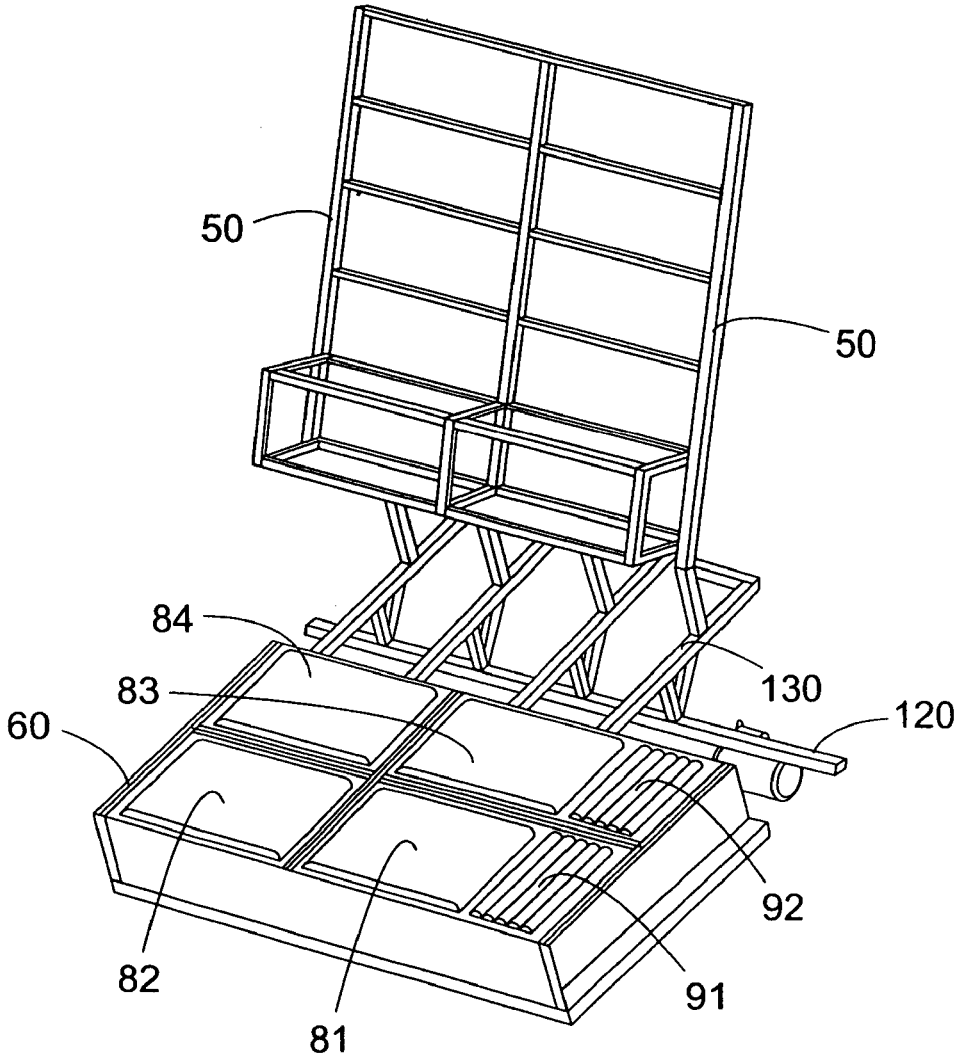
FIG. 5 is a perspective side view showing modules with ledge feeders and conveyors for storing and applying loading ledges in a application machine being a part of the application system in FIG. 2.

FIG. 5 only shows two of the four ledge feeders 50 and the bottom conveyors 81, 82, 83, 84 of the application machine 10 in more detail. Here, the loading conveyor 100, the feeding conveyor 110, the stored/stacked loading ledges 20, and movable application means are excluded for clarity reasons. The two shown ledge feeders constitute only one half of each pair of ledge feeders 50, and the other half, i.e. the other ledge feeder opposite each of the shown ones, is excluded for clarity reasons.

In FIG. 5, means for attachment, control and movement of loading ledges 20, when applied onto each unit load 30, are excluded for clarity reasons, and will be described when the application method according to the invention is described later on in this description.

Figure 6:
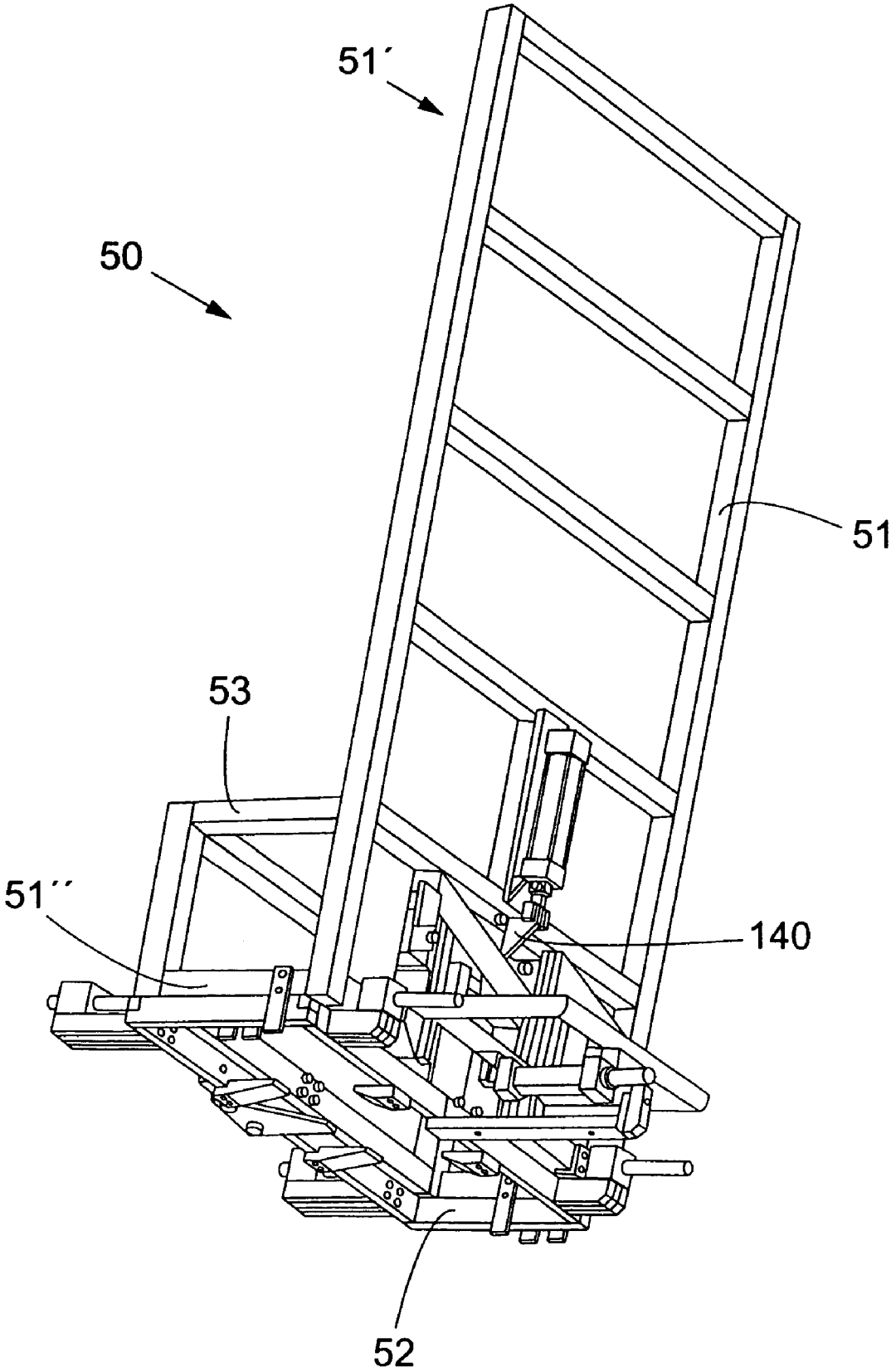
FIG. 6 shows one of the ledge feeders in FIG. 5 from below.

FIG. 6 shows one of the four ledge feeders 50 more clearly. Each ledge feeder 50 comprises a ledge frame 51 with a shape essentially corresponding to a L-shape when viewed from the side in FIG. 6, and a displaceable frame 52 for separating the lowest loading ledge 20 (shown in FIGS. 1-3) from the next one above it. A vertical frame part 51', i.e. the longer leg of the L-shaped ledge frame 51 extends upwards in FIG. 6. A horizontal frame part 51", i.e. the shorter leg of the L-shaped ledge frame extends to the left in FIG. 6. For clarity reasons, the vertical frame part 51' will be called the long leg of the ledge frame and the horizontal frame part 51" will be called the short leg of the ledge frame 51. For supporting and holding the two legs 51', 51" of the L-shaped ledge frame 51 together both vertically and laterally, a perpendicular support frame 53 is placed in the angle between the legs. The loading ledges 20 are stacked upon each other along the long leg 51' of the ledge frame 51 forming a pile of at least one loading ledge up to many loading ledges. The loading ledges are supported or held by the displaceable frame 52 in such a way that the loading ledge at the bottom of the loading ledge stack may easily be separated from the adjacent/next loading ledge above it. This separating mechanism for removing loading ledges will be explained in more detail with reference to FIG. 15.

In this embodiment, as shown in FIG. 6, the longer leg 51' of the L-formed ledge frame 51 comprises several supports in the form of essentially horizontal and parallel bars. These bars extend between two vertical and parallel legs forming the longer leg, whereby the vertical frame part, i.e. the longer leg 51' has a shape essentially corresponding to a ladder-like structure.

The horizontal frame part 51" (shown in FIG. 6) is attached to the displaceable frame 52 by screws (not shown) and attached to the support frame 53 and the long leg 51' by welding but could of course be attached by any other detachable or undetachable means.

Figure 7:
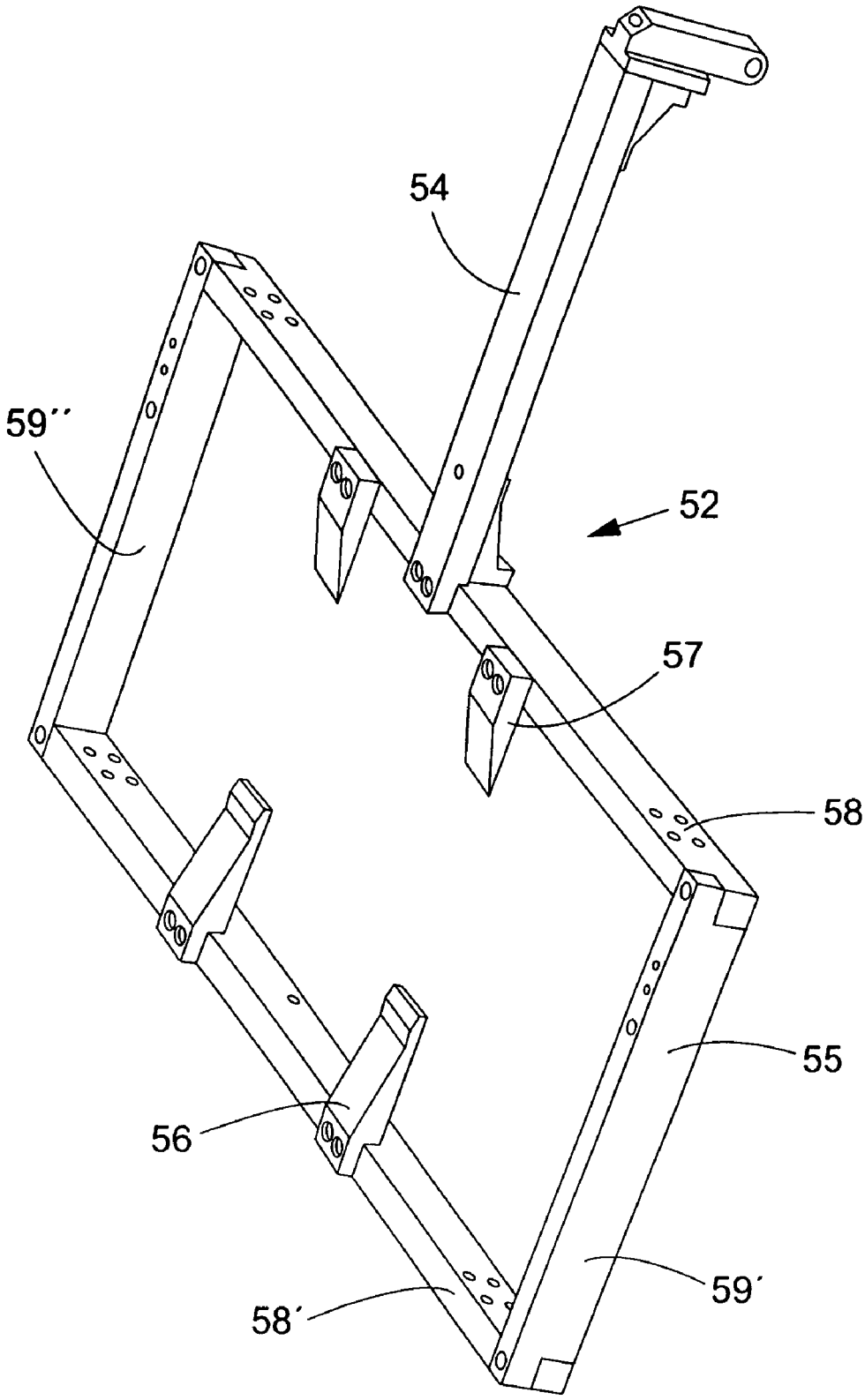
FIG. 7 shows a lower part of each ledge feeder in the application machine in FIG. 5 from below.

In FIG. 7, the displaceable frame 52 is shown from below in more detail without movable parts for displacement. The displaceable frame 52 comprises two main parts, a first protruding member 54 and a second rectangular member/frame 55. The protruding member 54 extends perpendicularly outwards from the middle section at one side of the second rectangular member and has a free end that is attached to means for displacing the frame 52 when mounted in the application machine 10. The protruding member is detachably attached at the other end to the second rectangular member 55 by screws. The protruding member may of course be attached to the second rectangular member by any other suitable means or methods, e.g. welding, soldering, or could even be an integrated part of the second rectangular member.

The second rectangular member 55 in FIG. 7 is formed by four members, two long members 58' and 58", and two short members 59' and 59". The protruding member 54 is attached essentially in the middle of the second member 58" of the two long members. The second rectangular member 55 also has two long projections 56 placed beside each other with a distance between them and arranged on the inside of the first long member 58'. The second rectangular member 55 also comprises two short projections 57 placed essentially opposite the two long projections on the inside of the second long member 58". The two short members 59' and 59" hold the two longer members 58' and 58" together, i.e. the two long members form the long sides of the rectangular frame 55 and the two short members form the short sides of the frame.

All of the projections 56, 57 in FIG. 7 are placed symmetrically on the inside of the long members 58', 58" and extend inwards and towards each other in pairs. Each of the long projections 56 extends towards one of the short projections 57. The two short projections 57 work as supports for the loading ledges 20 stacked upon each other. The two long projections 56 are used for separating the loading ledges from each other, as will be explained further with reference to FIG. 15.

Figure 15:
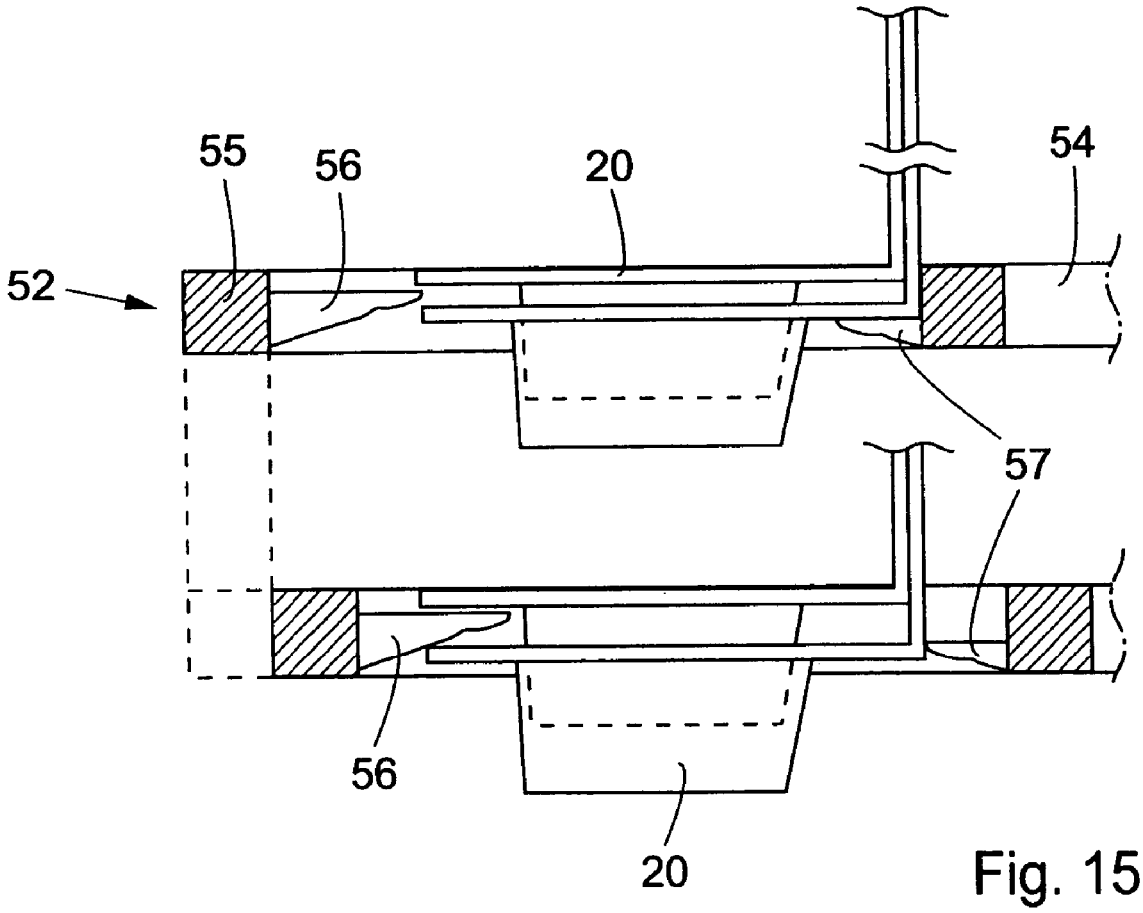

The upper surfaces of the four projections 56, 57 pointing downwards in FIG. 7 are placed at different heights, this is more clearly seen in FIG. 15. These upper surfaces of the longer projections 56 are placed higher than the upper surfaces of the shorter projections 57 against which the lowest loading ledge 20 rests when stacked in the ledge feeder 50. The support of the loading ledges could of course be achieved by any other means, e.g. ledges instead of separate projections or by pneumatically, mechanically or hydraulically controlled and movable devices or any other suitable means. There could also be more than two separating projections 56 and more than two supporting projections 57.

Figure 8:
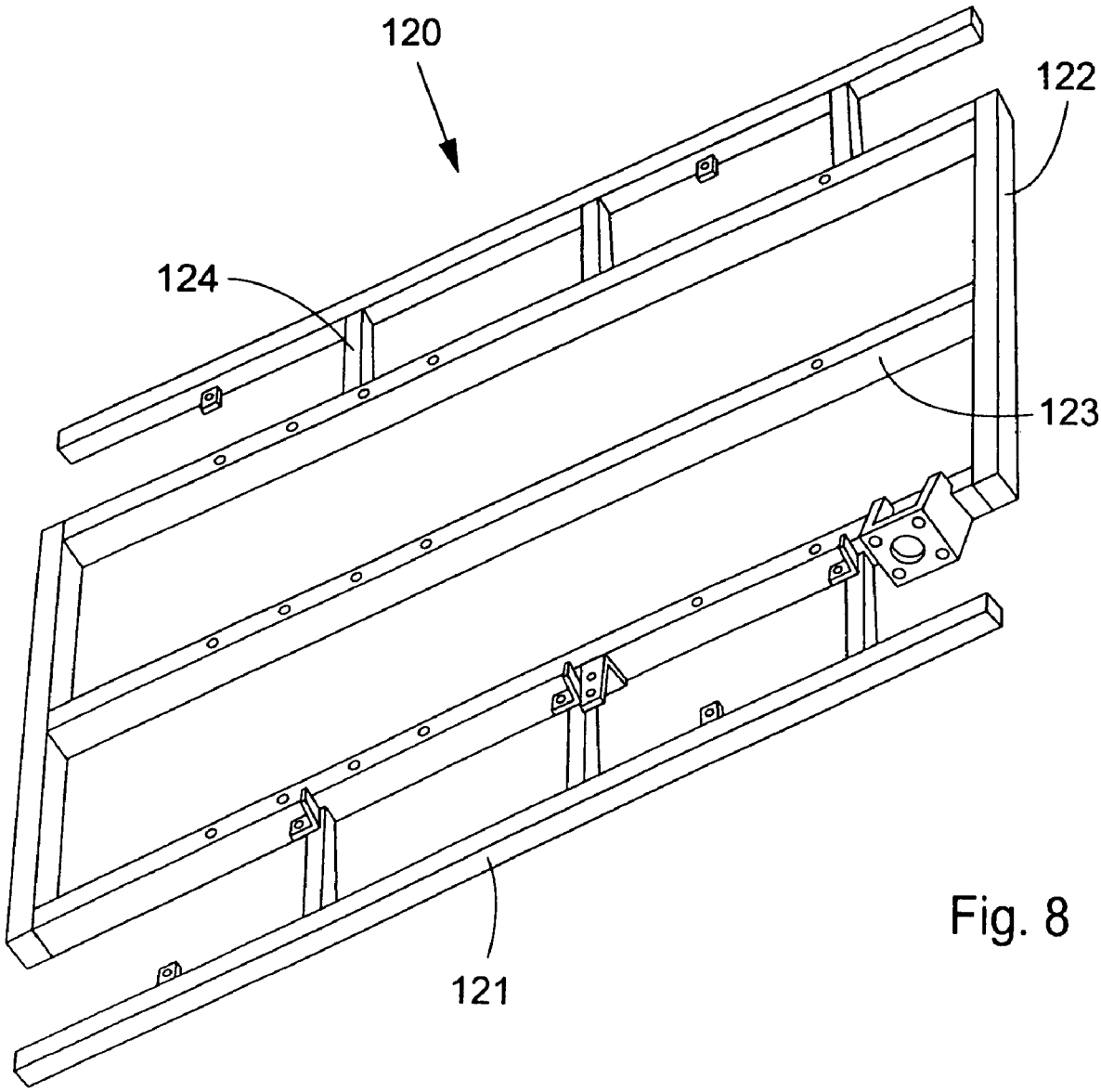
FIG. 8 shows a support means for supporting and holding the ledge feeder, conveyors and associated parts of the application machine in FIG. 5.

FIG. 8 shows the bottom frame 120 in more detail. The bottom frame has two slender horizontal and parallel members 121, two thick vertical and parallel members 122, three thick horizontal and parallel members 123, and six slender vertical and parallel members 124. The two thick vertical members 122 connect and hold the three thick horizontal and parallel members 123 with a certain distance from each other. These members 122 and 123 are perpendicular to each other and constitute the main part of the bottom frame 120. These members 122 and 123 have the shape of a rectangular frame with one of the three thick horizontal and parallel members dividing the frame into two rectangular frames. Moreover, the bottom frame has means in the form of holes and projections so that the bottom conveyors 81, 82, 83, 84 can be removably attached to it. Some of these means are also used for holding and supporting the removably attached ledge feeder supports 130 for each ledge feeder 50. This bottom frame can be designed in many ways, as is readily understood by a skilled person, and is therefore not explained further.

If the ledge feeders 50 and conveyors 81, 82, 83, 84, 100, 110 are designed as separate units, the bottom frame 120 is not necessary. Then, the ledge feeders and conveyors would not be directly attached to each other, e.g. they would be arranged on the floor or any kind of mounting instead, as explained earlier. This also means that the bottom conveyors 81, 82, 83, 84 and their frames would be mounted directly on the mounting or floor.

Figure 9:
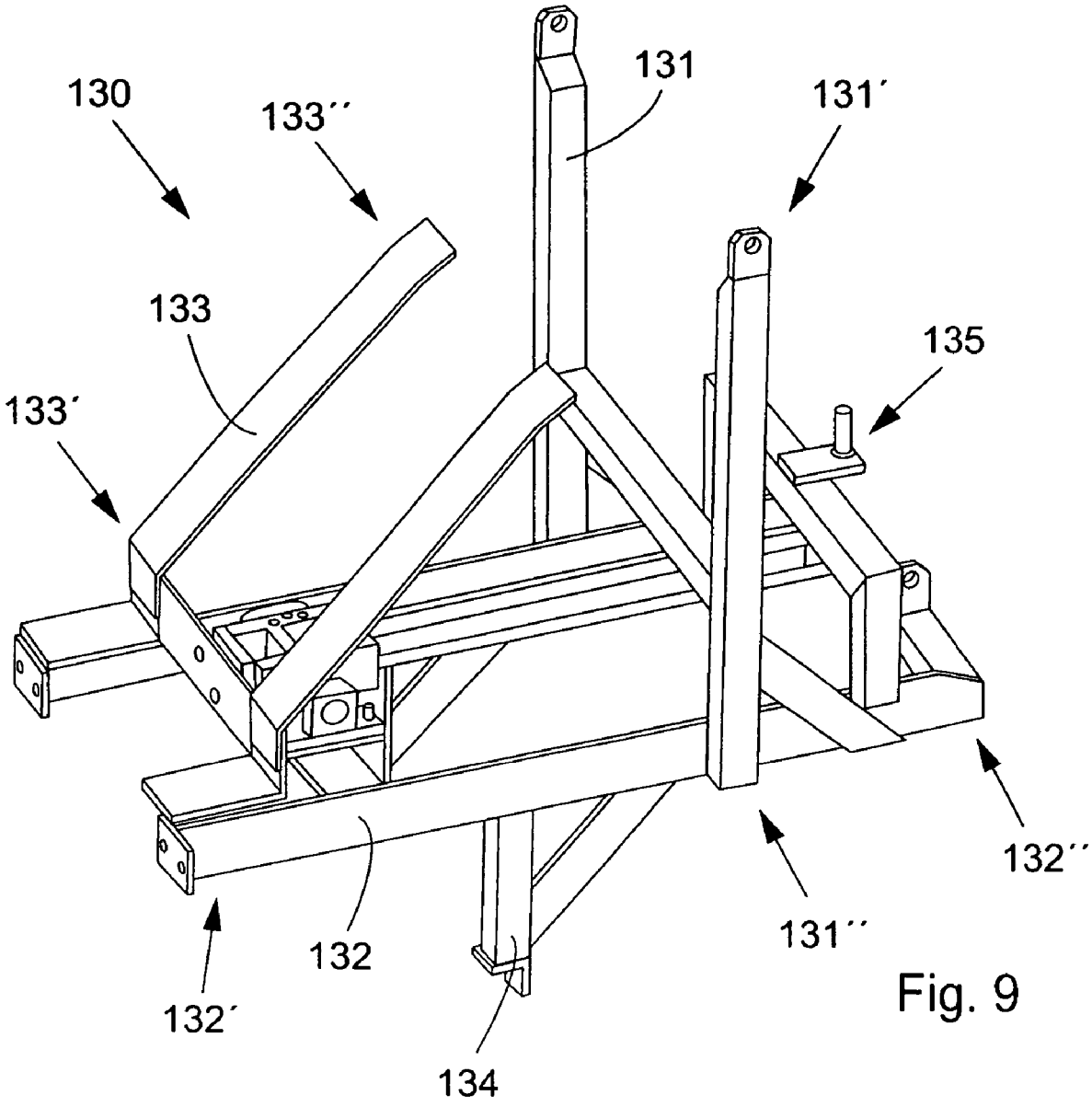
FIG. 9 shows another support means for connecting each ledge feeder to the associated parts of the application machine in FIG. 5, FIGS. 10 and 11 show parts of a mechanism for removing a loading ledge from the associated ledge feeder.

In FIG. 9, one of the ledge feeder supports 130 (also shown in FIGS. 3, 4, and 5) is shown in more detail. Each ledge feeder support comprises a pair of vertically upward extending connecting parts 131, against which the associated ledge feeder 50 is to be detachably mounted. Each ledge feeder support also comprises a pair of horizontally extending connecting members 132. Each of the horizontal connecting members is detachably mounted at a first end 132' onto the associated bottom conveyor 81, 82, 83, 84. Each ledge feeder support 130 also comprises inclined parts 133 for slidably transporting each loading ledge 20 from its stored upper position when the loading ledge is released into its lower application position. Each of the inclined parts 133 extends with an angle from a first end 133' adjacent the first end 132' of the associated horizontal connecting member 132 towards the vertically extending connecting parts 131. A second end 133" of each inclined part 133 ends a distance from the vertically extending connecting parts, i.e. the second end 133" is a free end. Moreover, each ledge feeder support also comprises support members 134 extending vertically downward. The vertical support members 134 act as supports against the member 121 (shown in FIG. 8) of the bottom frame 120 (also shown in FIG. 5). Each ledge feeder support 130 also comprises support means 135 for attachment of devices, e.g. pneumatically or hydraulically driven cylinders, for displacing the frame 52 during operation of the application machine 10.

Each of the vertical connecting parts 131 in FIG. 9 has a first free end 131' and a second end 131" connected to the horizontal connecting members 132. The second end 131" is attached to its associated horizontal connecting member 132 at a position essentially in the middle of the horizontal connecting member. This second end 131" is preferably attached against the associated horizontal connecting member 132 at a distance from a second end 132" of the horizontal connecting member. This distance is about one third of the total length of the horizontal connecting member. This means that the second end 132" of the horizontal connecting member protrudes a certain distance, in this case, about one third of its total length from the connecting point of the vertical connecting part and is terminated as a free end 132" to the right in FIG. 9.

Figure 13:
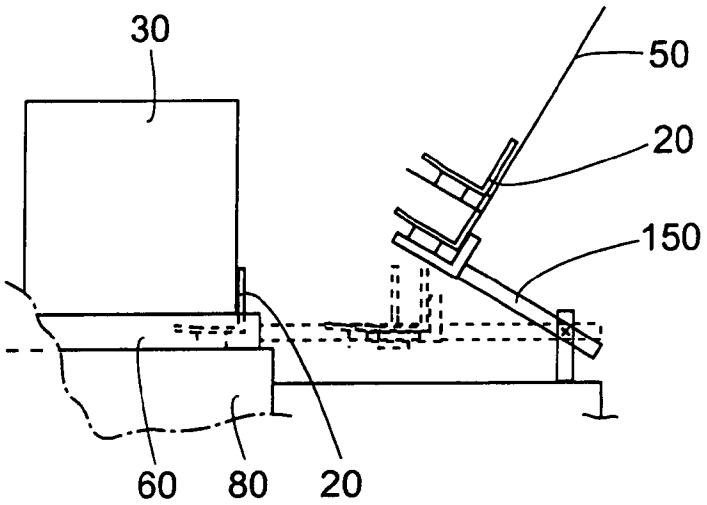
FIGS. 12-15 show different steps when applying the loading ledges by using a method utilising the application system with the application machine according to the invention.
Figure 12:
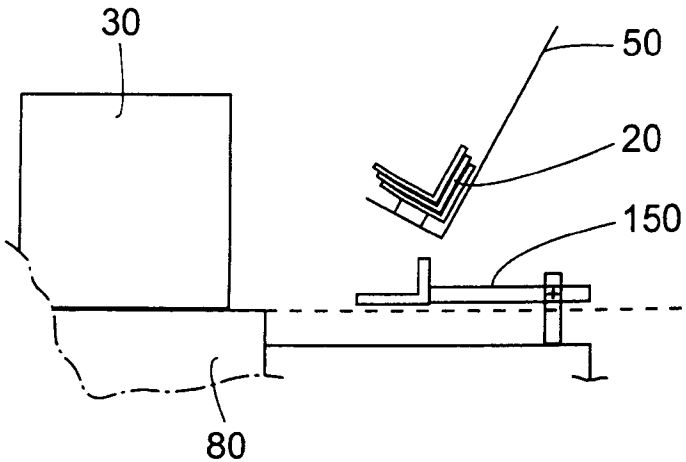
Figure 14:
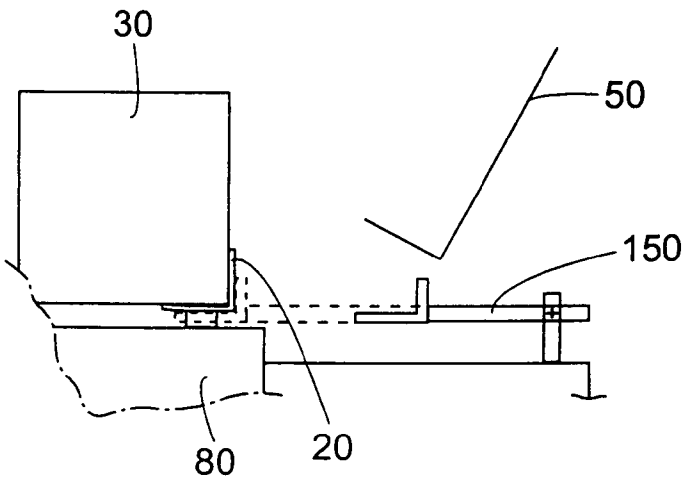

Alternatively, in another embodiment of the ledge feeder support 130, the inclined parts 133 may be excluded and replaced with a pivotable device (shown in FIG. 12-14). This device could have an arm 150 with a first end being moved in a path essentially corresponding to the shape/contour of the inclined parts 133 when seen from the side.

A further development of the ledge feeders 50 would be to lower each ledge feeder 50 by eliminating the vertical connecting parts 131 of the ledge feeder support 130. This means that each ledge feeder 50 would be attached directly onto the horizontal connecting members 132, and that the loading ledges 20 when released could fall into and be received by an arm movable only in the horizontal direction.

Figure 10:
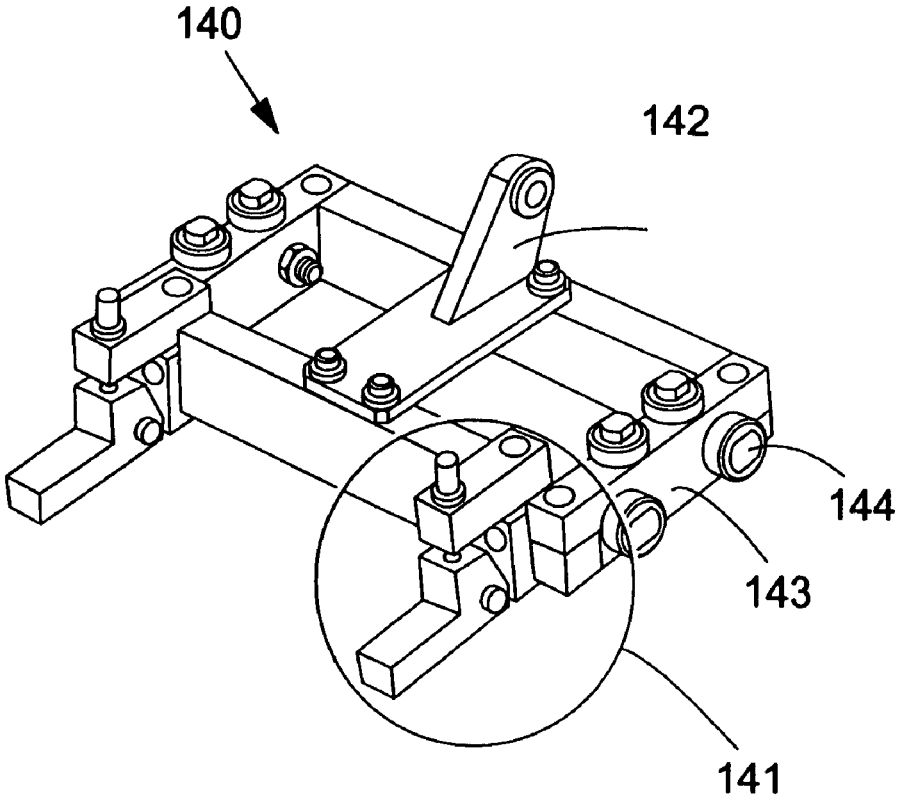
Figure 11:
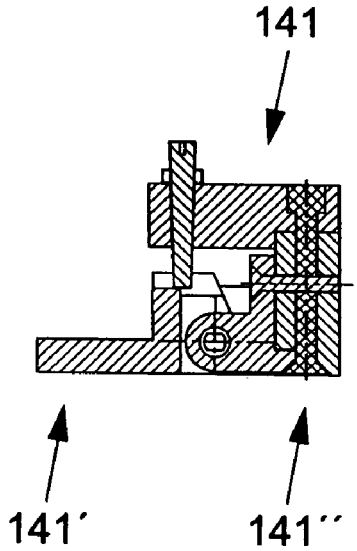

FIGS. 10 and 11 shows the detachment device 140 of each ledge feeder 50 (shown in FIG. 6) for removing or detaching each loading ledge 20 from the next loading ledge that is stacked above it. The detachment device 140 comprises two finger-like members 141, a support member 142 in the form of an ear, and a frame 143. The detachment device also comprises guide rolls 144 for controlling the movement of the detachment device when operating. The guide rolls 144 move inside a path (not shown) having guiding surfaces, against which the guide rolls roll, thereby guiding the detachment device in the right path. The ear 142 is attached to operating means for moving the detachment device 140 and the finger-like members so that the finger-like members 141 "Peel off", i.e. removes a first loading ledge from the next above it. Each of the finger-like members 141 comprises a first end 141' and a second end 141". The first end 141' contacts the vertical flange 21 of the loading ledge (shown in FIG. 2) to be released and pushes it down until the loading ledge is released. The frame 143 is fixed to the lower backside of the ledge feeder 50, as shown in FIG. 6. This procedure will be explained in more detail when the method according to the invention for application of the loading ledges is described later in this description. The means for operating the detachment device 140 could for example be pneumatically or hydraulically driven cylinders.

FIG. 12-15 show the different steps in the method according to the invention for mounting loading ledges 20 onto two opposite, lower edges of each unit load 30 by utilising the application machine 10 according to the invention. The application method will now be described with reference to these drawings.

In FIG. 12, a side view shows parts of the application machine 10. Here, one unit load 30 is transported or moved into a first position in the application machine 10 and is stopped in a first application position. Here, a part of the unit load 30, a part of the bottom conveyors 80, the loading ledges 20, one ledge feeder 50, and the telescopic pivotable arm 150 of the application machine 10 are schematically shown for clarity reasons. The telescopic arm 150 has a first end shaped as a perpendicular angle, similar to a chair, for receiving each loading ledge. This shape is adapted to the L-shape of the loading ledges.

FIG. 13 shows the unit load 30 in an elevated position, i.e. the unit load is lifted and held by the lifting frame 60 in a second application position. Here, the arm 150 has been raised in a pivot movement by means of a pivoting mechanism (not shown) to receive a loading ledge 20 soon to be released. The lowest loading ledge is then released and falls into the arm 150, also shown in FIG. 13. In the next step, also shown with dashed lines in FIG. 13, the arm 150 has been pivoted downwards and has reached its horizontal application position. In this position, the telescopic arm 150 is pushed forward towards the lower edge of the unit load 30, also shown with dashed lines. The arm, i.e. its first receiving end, is pushed forward until the upper vertical flange 21 of the loading ledge 20 (shown in FIG. 2) comes into contact with the unit load 30.

In the next step, as seen in FIG. 14, the unit load 30 has been lowered by the lifting frame 60 until it contacts the upper surface of the horizontal flange 22 of the loading ledge 20. Then, in FIG. 14, the telescopic arm 150 is pulled back or withdrawn to the right, as shown with dashed lines. Finally, the unit load 30 with loading ledges 20 is transported or moved out of the application machine 10 so that another unit load may be transported or moved into the application machine and be equipped with loading ledges.

The above-described steps or at least some of them, in the method utilising the application machine 10 may of course be performed simultaneously. The lifting of the unit load 30 by means of the lifting frame 60 and the moving of the telescopic arm 150 can be done at the same time. This is readily understood by a skilled person. Furthermore, there is only described one application of one loading ledge at only one lower edge of the unit load 30 in the application machine. An application of another loading ledge is of course performed opposite the shown loading ledge at the same time but this application is not shown or described for clarity reasons. The loading ledges are applied in pairs at opposite lower edges of each unit load.

The separating of stacked loading ledges 20 is shown more clearly in FIG. 15. Here, the displaceable frame 52 is moved in a first step to the right a distance essentially corresponding to the length of the short projections 57 on the second rectangular frame 55. Then, in a second step, the longer projections 56 move in between the lowest loading ledge and the one above it until inclined lower parts of the long projections contact the horizontal flange 22 of the lowest loading ledge 20. The inclined part then starts pushing/forcing the lowest loading ledge downwards while hindering the loading ledge above from following it. The inclined part pushes the lowest loading ledge until it is released by means of the detachment device 140 (shown in FIGS. 6 and 10).

The peeling off-function of the detaching device 140 could be achieved by means using vacuum for gripping the lowest loading ledge 20. These vacuum means would pull the lowest loading ledge loose from the loading ledge above it and release it so that it is transported into its application position instead of finger-shaped members 141. This gripping of loading ledges by using vacuum may be achieved by means in the form of suction cups or suction power generated by air while, at the same time, holding the loading ledge 20 above the gripped lowest loading ledge when the gripped loading ledge is removed.

The ledge feeders 50 could also be positioned horizontally so that the loading ledges 20 were to be removed from each other in the horizontal direction instead of the vertical direction. The ledge feeders could also be placed below the conveyors, e.g. in the floor, and the loading ledges at the top would be removed from the ones below instead of vice versa. The loading ledges could also be fed/applied by being transported on a inclined path or conveyor. Then, a first end of the loading ledge would be moved into contact with the lower edge of the unit load 30 due to the inclination of the path and starts to lift the unit load and a second end of the loading ledge would follow until the unit load were fully lifted.

Each of the loading ledges 20 is preferably made of only one recyclable plastic. This means that the loading ledges are easily recycled, firstly, by being granulated, melted and moulded into a new loading ledge after it has been used only once.

This would reduce the number of transports of loading ledges. It also ensures a more reliable storing, feeding and handling of loading ledges because there is no risk of using a broken loading ledge a second time.

The design and structure of the loading ledges also enable a larger storage of loading ledges without increasing the required space. Moreover, more loading ledges may be transported in a truck or on a train if the loading ledges are to be used more than once in comparison to wooden pallets.

The invention claimed is:

1. A system for applying loading ledges onto a unit load positioned on supporting means, the system comprising an application machine, said application machine comprising means for separating the unit load from the supporting means in the vertical direction, and means for applying at least one loading ledge to at least two opposite, lower edges of the unit load when separated from the supporting means, wherein the application machine is placed between a loading conveyor and a feeding conveyor.

2. A system according to claim 1, wherein the means for applying at least one loading ledge is provided with at least one pair of ledge feeders.

3. A system according to claim 2, wherein the means for separating the unit load from the supporting means is a vertically movable separating frame.

4. A system according to claim 3, wherein the vertically movable separating frame is made of flat bars placed edgeways.

5. A system according to claim 4, wherein the vertically movable separating frame comprises at least one part having a shape when seen from above essentially corresponding to a H.

6. A system according to claim 2, wherein each ledge feeder comprises an essentially L-shaped frame having a vertical frame part, a horizontal frame part, and a support frame placed under the two frame parts.

7. A system according to claim 6, wherein each ledge feeder further comprises a detachment device for automatically removing a lowest loading ledge from a loading ledge above it.

8. A system according to claim 7, wherein the detachment device is a pneumatically, hydraulically, or electrically driven mechanism.

9. A system according to claim 1, wherein the supporting means are fixed supports.

10. A system according to claim 1, wherein the supporting means are conveyors.

* * * * *